United States Patent [19]

Marshall

[11] 4,270,590

[45] Jun. 2, 1981

[54] CASE WITH A CHANGEABLE EXTERNAL APPEARANCE

[76] Inventor: Joseph F. Marshall, 1533 1/2 Centenella, Inglewood, Calif. 90302

[21] Appl. No.: 78,489

[22] Filed: Sep. 24, 1979

[51] Int. Cl.[3] ..... A45C 3/02; A45C 3/08

[52] U.S. Cl. ..... 150/1.6; 150/28 A; 190/49; 190/54

[58] Field of Search ..... 150/28 A, 28 R, 1.6, 150/46; 220/402, 405, 406, 410; 190/41 C, 54, 49

[56] References Cited

U.S. PATENT DOCUMENTS

| | | | |
|---|---|---|---|
| 1,980,684 | 11/1934 | Hiering | 150/46 |
| 2,464,956 | 3/1949 | Winter | 159/46 |
| 3,575,226 | 4/1971 | Chapman | 150/28 A |
| 4,027,710 | 6/1977 | Keebler | 150/28 A |

FOREIGN PATENT DOCUMENTS

| | | | |
|---|---|---|---|
| 111393 | 7/1964 | Czechoslovakia | 150/28 A |

*Primary Examiner*—Donald F. Norton
*Attorney, Agent, or Firm*—Fulwider, Patton, Rieber, Lee & Utecht

[57] ABSTRACT

A case, suitcase or briefcase with an externally changeable appearance includes mating sections hinged along one edge with side coverings providing a plurality of surfaces for exterior exposure releasably captured by a framework on each section. The surfaces are selectively positionable in exposed and concealed arrangement to allow the user to change the external exposed surface, and thereby alter the color, texture and other appearance features of the case.

4 Claims, 10 Drawing Figures

FIG. 1
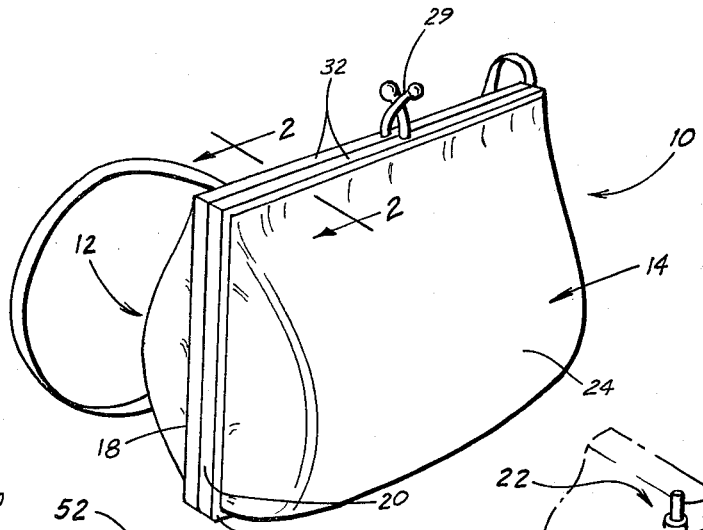
FIG. 4
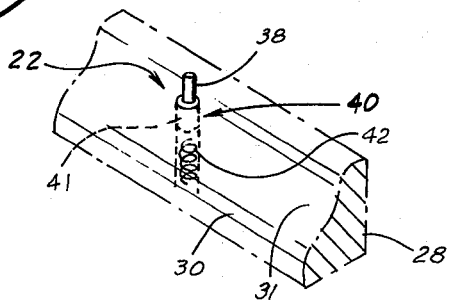
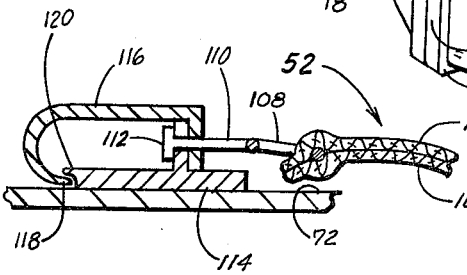
FIG. 10
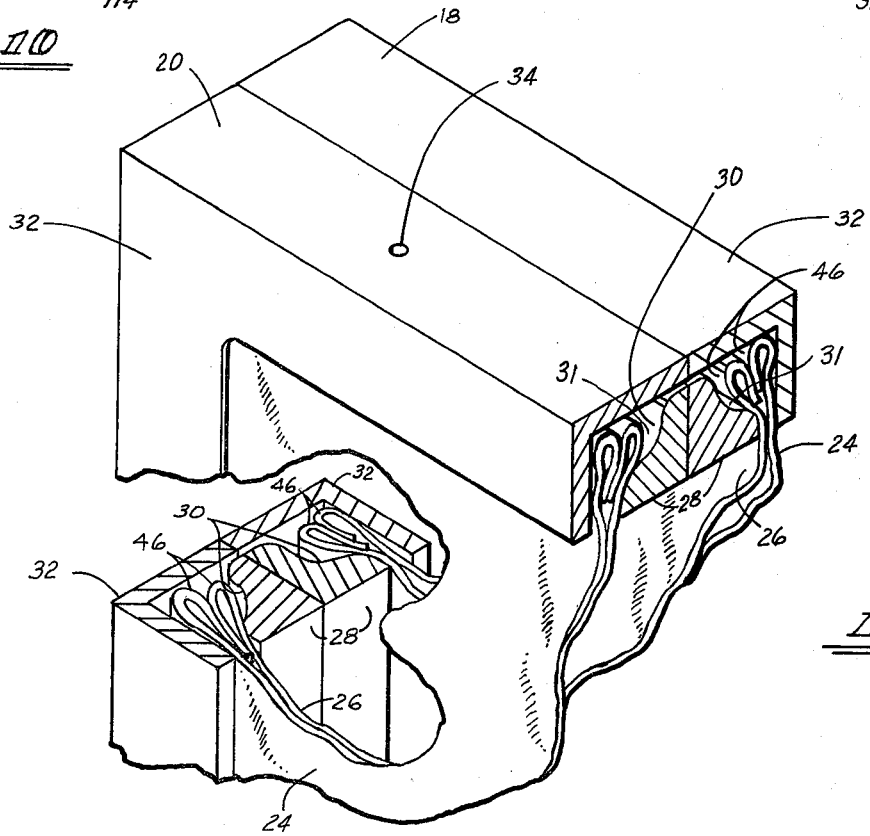
FIG. 2
FIG. 3
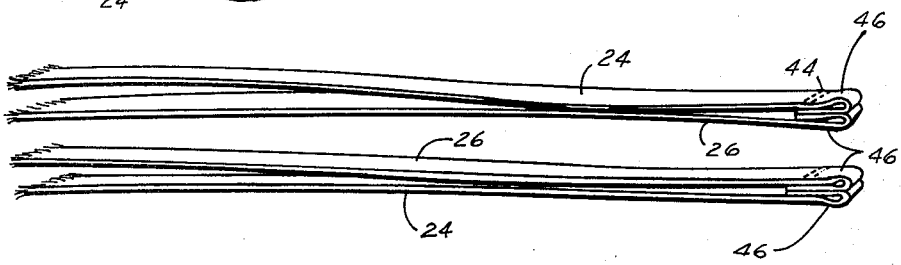

CASE WITH A CHANGEABLE EXTERNAL APPEARANCE

BACKGROUND OF THE INVENTION

1. Field of the Invention

The present invention relates to carrying cases, including suitcases, briefcases, instrument carrying cases, and other portable, nondisposable carrying containers.

2. Description of the Prior Art

Heretofore, handbags, briefcases and other carrying devices of a nondisposable nature have been constructed with a single type of exposed surface for each bag. That is, the manufacturer determines the particular color, texture and styling design for the surface covering of each bag, and provides expansive side coverings accordingly which have a single color and texture of surface adapted for external exposure. This limits severely the adaptability and social appropriateness of the bag under varying conditions. That is, conventional bags allow no flexibility in color cordination or in texture coordination with different clothing apparel which the user may wear. Such considerations are especially important in ladies handbags and purses, although they are quite important as well in men's briefcases, suitcases, and with other types of non-disposable containers. Individuals are thereby forced to either purchase and store a number of different bags for use with different apparel outfits, or they must use the same bag even though the exposed surface thereof frequently clashes or is otherwise inappropriate for use on particular occasions.

SUMMARY OF THE INVENTION

The present invention is a unique and novel improvement on the ordinary briefcase, accessory case, valise, travel bag and upon other nondisposable types of carrying containers. The present invention employs at least one side covering which provides a plurality of surfaces for selective and alternative exterior exposure. These sections are releasably captured by fasteners on a rigid framework on each of two sections which mate together to close the case. A single basic carrying structure can thereby be utilized, yet with the flexibility heretofore attainable only with several complete alternative cases. The color, design and texture of the side coverings of cases according to the invention may be rendered suitable from a fashion standpoint with a wide variety of wearing apparel styles and colors.

Since the case of the invention is provided with more than a single surface adapted for exterior exposure, the case is likely to last much longer than do conventional bags, since no single exposed surface is subjected to extensive wear. Moreover, in the case of damage, such as a tear or burn, the product is not rendered useless, and serious and costly repair may be postponed for some length of time. Rather, the damaged covering need merely be repaired or replaced. By having several options available as to color and design in a single unit, a person who travels can carry a single case, rather than alternative wardrobe selections as might otherwise be necessary. Since much of the cost of handbags, briefcases, and the like, involves basic structural workmanship and durability of the rigid, functional components, the additional cost of providing extra shells or skins for use with such cases to afford the user color or design flexibility represents only a small addition to the basic structural costs of such devices.

The case of the invention may be utilized with either rigid, nested shells, a surface of which is exposed while the remainder are concealed therebeneath, or with flexible skins which may be interchanged to expose differing surfaces as desired. Changes in the skins or shells are easily achieved using one of several possible quick release retainer concepts.

The flexible sided case allows a broad range of fashion compatibility with a persons style, mood or color of dress. The alternative skins for flexible coverings can be selected by the user at the time of initial purchase to maximize the compatibility of the several alternative choice to suit the personality of the user. Quickly and easily, a user can significantly change the exterior appearance of any case by literally changing the external skin or covering. Preferably, in the case of soft coverings the, skin is a flexible fabric, leather or synthetic plastic with a bead, a fastening flange, or other device for simple attachment, around its outer perimeter to conform to the framework of the bag or case with which it is used. In the case of a hard covered device, such as a briefcase or suitcase, the coverings are preferably rigid shells which are nested together so that the selected shell is exposed on the exterior of the bag and the other shells are trapped therebeneath concealed from view. The nesting order of the shells can be changed by releasing the releasable fasteners at the framework of the bag so that the shells can be interchanged.

The shells which are utilized may either be cut from fabric, leather, or synthetics such as naugahyde or polyvinyl chloride. The coverings are molded, cut or sewn to appropriate size and shape and either layered or nested in such a manner as to allow them to become an integral part of the case. The use of a plurality of skins or shells also serves to give the case additional strength and durability.

A further "commercial" application of the invention would be to use specific colored shells as a color "code" to indicate the contents of the case. This application could conceivably include emergency equipment of different types, instruments of different function, tools for differing job requirements, etc., where these were maintained in a common storage area.

This invention also allows shared usage of a so-called luggage set in that part of the "set", basically of masculine appearance, could be changed outwardly to be made suitable for a female.

The invention may be described with greater clarity and particularly by reference to the accompanying drawings.

DESCRIPTION OF THE DRAWINGS

FIG. 1 is a perspective view of a soft sided bag according to the invention.

FIG. 2 is a sectional detail, partially broken away, in perspective and taken along the lines 2—2 of FIG. 1.

FIG. 3 illustrates the arrangement of soft skins laid flat for use in the bag of FIG. 1.

FIG. 4 is a detail of the releasable fastening mechanism employed in the embodiment of FIG. 1.

FIG. 10 is a sectional detail of the attachment of the bag handle depicted in FIG. 5.

In FIG. 1, a ladies handbag 10 constructed according to the invention is illustrated. The handbag 10 is comprised of mating soft sided sections 12 and 14 which are hinged along the bottom edge at 16 by conventional metal hinges, (not shown) the leaves of which are attached to the opposing rigid rectangular shaped finished metal, frameworks 18 and 20 associated with the hinged sections 12 and 14 of the bag respectively. Releasable fasteners of the type depicted at 22 in FIG. 4 are utilized to entrap a plurality of expansive, flexible side coverings or skins 24 and 26, depicted in FIG. 3, to each of the sections 12 and 14 of the bag.

Figure 5:
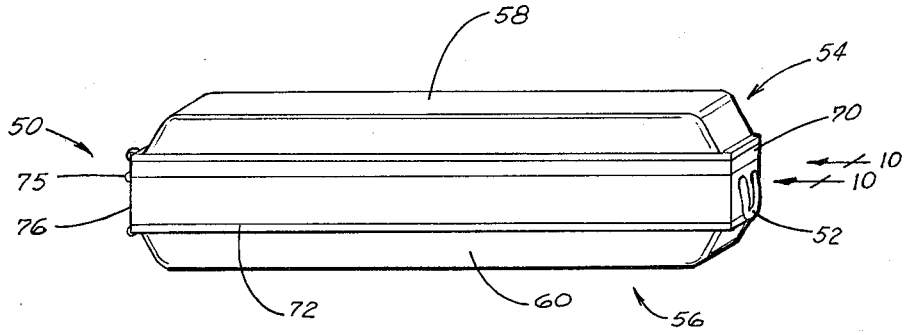
FIG. 5 illustrates a hard shelled case constructed according to the invention.

The construction of the open rectangular frameworks 18 and 20 is illustrated in the sectional detail of FIG. 2. Each of the frameworks 18 and 20 is provided with a fixed rim 28 to which the leaves of the hinges fastening the sections 12 and 14 together along the bottom edge 16 of the handbag 10 are secured. Each of the rims 28 is roughly of a right triangular shaped cross sectional configuration, so that the backs of the rims fit together in face to face disposition as illustrated in FIG. 2. The surfaces of the rims 28 which face away from each other are illustrated at 30, and are not of linear cross section, as in a true triangle but rather include a concave depression 31 near the center thereof. Exteriorally of each of the rims 28 there is an open rectangular removable finished metal band of L-shaped cross section depicted at 32 in FIGS. 1 and 2. The frameworks 18 and 20 may be latched together by a conventional purse clasp 29, depicted in FIG. 1. The band 32 includes a series of spaced peripheral apertures 34 along its outwardly facing edge around the three unhinged sides of the frameworks 18 and 20. These apertures 34 are adapted to receive the tips 38 of spring loaded latching pins 40 which are biased outwardly by springs 42 from the structure of the rims 28, as depicted in FIG. 4. The bases 41 of the latching pins 40 are larger in diameter than the tips 38 and are entrapped in cavities in the rim 28.

A plurality of flexible skins are selected with the purchase of the handbag 10. The skins 24 and 26 are both folded back along the perimeter of their edges and stitched at 44 so that a folded loop or bead 46 exists around the entire perimeter of each of the skins 24 and 26. The skins 24 and 26 are not attached to each other, but are positioned together with their beads 46 in juxtaposition as illustrated in FIG. 3.

To assemble the handbag 10, a pencil or some other narrow instrument is used to depress the tips 38 of the spring loaded latching pins 40 to disengage them from the apertures 34. This is best achieved by beginning at the corner of one of the frames and depressing the latching pins 40 while concurrently lightly pulling the band 32 away from the rim 28 to which it is held. Once the tip 38 is removed from registration with the aperture 34, the band 32 will flex sufficiently to prevent re-enagement. The process is repeated pin by pin until all of the latching pins 40 have been released and the band 32 is then removed entirely from the rim 28.

The skins 24 and 26, arranged as desired with the particular surface selected for exposure disposed outwardly, are positioned as illustrated in FIG. 3. The skins 24 and 26 are then wrapped together about the structure of the handbag 10 and the beads 46 thereof, residing in contact with each other, are pressed into the concavity 31 in the rim 28. The closure band 32 is thereupon positioned adjacent to the rim 28 as depicted in FIG. 2 and pressed against the rim 28 in alignment therewith to entrap entirely the beads 46 of the skins 24 and 26 about the perimeter of the framework 18 and 20.

As the band 32 is pressed into position, the tips 38 of the latching pins 40 are depressed to allow passage of the structure of the bands 32 until registration with the apertures 34 is achieved. Thereupon the latching pins 40 spring outward so that the heads 38 thereof lodge in the apertures 34 and fasten the frames 32 securely to the rims 28.

Figure 6:
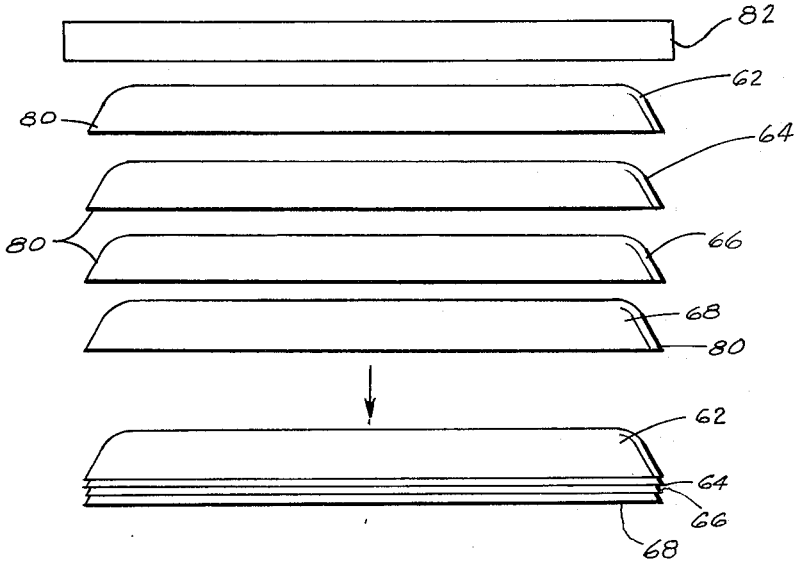
FIG. 6 illustrates the arrangement of the hard shells and the manner in which they are nested.
Figure 7:
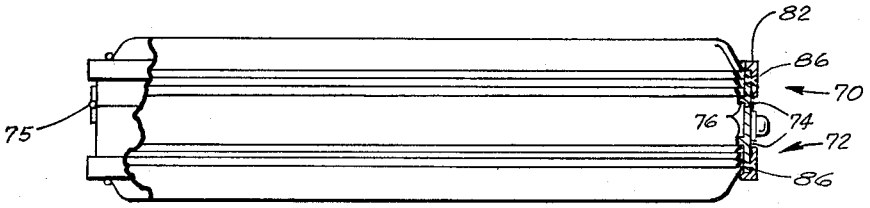
FIG. 7 illustrates in partial section the shells of FIG. 6 arranged on the bag of FIG. 5.

An alternative embodiment of the invention is depicted in FIGS. 5–7. As illustrated in FIG. 5, a rigid walled briefcase 50 having a handle 52 attached thereto for carrying is illustrated resting upon its side. The briefcase 50 has opposing mating hinged sections 54 and 56. The sections 54 and 56 present exposed surfaces 58 and 60 of one of a plurality of nesting, rigid shells 62–68, which are selectively positionable for external exposure thereby entrapping and concealing the others of the shells therebeneath, as illustrated in FIG. 6.

The handle 52 is illustrated in section in detail in FIG. 10. The handle 52 includes a reversible hand strap with two fabric strips 104 and 106, sewn or laminated together. The strips 104 and 106 are of differing colors or textures. The strip 104 is illustrated in an exposed position, although the strap can be turned over so that the strips 106 faces outwardly away from the briefcase 50. The strap is held in place by a rectangular wire link 108 from which a stem 110 extends to terminate in an enlarged head 112. The head 112 is entrapped between a baseplate 114 fastened to the framework 72 and a cap 116 secured to the baseplate 114 by a snap lock fit with a lip 118 that is received beneath a ledge 120 on the baseplate. The strap of the handle 52 will be reversed in co-ordination with the particular one of the shells 62–68 to achieve complete color texture coordination.

As in the embodiment of FIGS. 1–5, the rigid-walled briefcase 50 includes surrounding frameworks 70 and 72 extending about the perimeter of the hinged sections 54 and 56 respectively. The frameworks 70 and 72 are each comprised of a rim 74 to which hinges 75 along the hinged edge 76 of the briefcase 50 are attached. The rims 74 are of generally rectangular configuration about the briefcase 50 and include interiorally directed ledges 76 against which the edges of the nested shells 62–68 reside in abutment. The nested shells 62–68 are configured with laterally outwardly extending lips 80 about the perimeter of their edges. An encircling finished metal L-shaped band 82 is provided to entrap the lips 80 and to compress the nested shells 62–68 together to hold them in nested positions on each of the sections 54 and 56. The encircling bands 82 may be fastened to the interiorally located rims 74 by means of small screws 86 which may be releasably secured at spaced locations along each of the frameworks 70 and 72.

Numerous alternative releasable fastening systems may be employed in place of those heretofore described. For example, the encircling bands may be of variable length so as to allow them to be selectively arranged to entrap the nested shells 62–68, or allow removal and rearrangement of the order of these shells.

Figure 8:
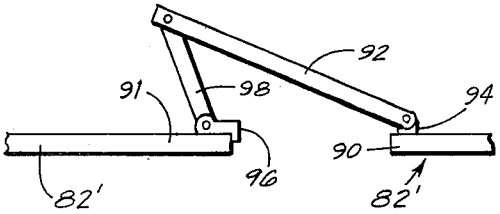
FIG. 8 is an alternative fastening mechanism to that depicted in FIG. 7.

FIG. 8 illustrates in detail the ends 90 of an encircling L-shaped metal band 82' which extends almost about the entire perimeter to encompass one of the hinged sections 54 or 56. This length of metal band 82' forms an encompassing section of the band 82' with its opposite ends 90 and 91 proximately positioned relative to each other as indicated. A hinged displaceable section 92, hingedly attached to one end 90 of the metal band 82' by means an upstanding lug 94 forms another displaceable section. The underside of the displaceable section 92 is concave, generally rectangular and cup-shaped to receive therewithin a link 98. A cap 96 is securely fastened to the other end 91 of the band 82' and includes a small hinge to which the link 98 is rotatably fastened. The opposite end of the link 98 is rotatably fastened by means of a hinge axle to the displaceable section 92 of the fastening structure.

When the nested shells 62–68 are arranged in the desired order, the band structure of FIG. 8 may be positioned loosely about the perimeter of one of the sections 54 or 56 with the displaceable section 92 and the link 98 generally linearly aligned to increase the overall length of the band 82' to allow it to be maneuvered into position. Once in position, the overall length of the band is shortened by swinging the displaceable section 92 of the snap lock fastener of FIG. 8 outward and drawing the ends 90 of the encompassing band section 82' toward each other. When the ends 90 are brought into the proximity depicted in FIG. 8, the displaceable section 92 can then be swung back toward the encompassing band section 82'. This applies a tightening stress to the band section 82' by means of the link 98, which bears against the cap 96, thereby drawing the ends 90 and 91 of the encompassing band section 82' together further. Fastening is complete when the displaceable section 92 is moved all the way toward the encompassing band section 82' to reside in a parallel, overlapping condition relative thereto. The displaceable section 92 collapses over the link 98, thereby forcing the ends 90 and 91 of the encompassing section 82' toward each other.

Figure 9:
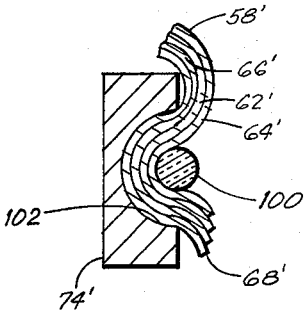
FIG. 9 is another alternative fastening mechanism to that depicted in FIG. 7.

Yet another alternative embodiment of the releasable fastener in which the encompassing band is of a variable perimeter length is illustrated in FIG. 9, and in which flexible coverings 62', 64', 66' and 68' are substituted for the rigid shells 62–68. In the embodiment of FIG. 9, a bungi cord 100 is illustrated in cross section. The bungi cord 100 is an elastic cord of circular cross section which extends in an endless loop and which may be placed to run about the perimeter of the frameworks 70 and 72. The rims 74' are constructed with a generally semicircular grooves 102 therein likewise extending about the outer perimeter of the frameworks 70 and 72. Flexible coverings 62', 64' 66' and 68' are arranged in the order desired so that the selected surface 58' thereof faces outwardly. The edges of the flexible coverings 62'–68' are then positioned adjacent the grooves 102. Each elastic bungi cord 100 is then placed in tension and positioned adjacent the groove 102 to encircle one of the frames 70 and 72. The bungi cord is then allowed to contract, thereby drawing the edges of the flexible coverings 62'–68' into the groove 102 and also drawing itself into the groove. The covering are thereby secured relative to the rim 74' with the desired surface of 58' of selected color disposed outwardly to complement the wearing apparel of the user.

It will become readily apparent to those familiar with nondisposable carrying bags and cases that numerous variations and modifications of the invention may easily be devised. Numerous fastening systems, alternative to those depicted and described herein are available. Accordingly, the scope of the invention should not be construed as limited to the specific embodiments depicted and described, but rather is defined in the claims appended hereto.

I claim:

1. A case with a changeable external appearance comprised of mating sections hinged along one edge, each section having a rigid framework with at least one releasable fastener, and each section is provided with a plurality of side coverings formed as nested shells compressed together; each shell having an outer surface for exterior exposure, and each shell being selectively positionable for external exposure, and said shells of each section are captured by said rigid framework and releasably held by said fastener, whereby each of said outer surfaces of said shells of said plurality of side coverings is selectively positionable for external exposure to thereby conceal therebeneath the outer surfaces of the other shells of the same section.

2. A bag according to claim 1 further characterized in that said releasable fasteners are encircling bands of variable perimeter length.

3. A case according to claim 2 further characterized in that each of said bands includes an encompassing section with proximately positioned opposite ends and a displaceable section and a link means for bringing said displaceable section into an overlap condition relative to said encompassing section and for concurrently drawing said opposite ends of said encompassing section toward each other.

4. A case according to claim 1 further characterized in that each of said shells is a rigid structure.

* * * * *